US006443085B1

(12) United States Patent
Akahani et al.

(10) Patent No.: US 6,443,085 B1
(45) Date of Patent: Sep. 3, 2002

(54) METHOD FOR KEEPING A SUBMERGED STRUCTURE FROM BEING ADHERED TO BY AQUATIC ORGANISMS

(75) Inventors: Kaoru Akahani, 77-8 Fukushima, Kurashiki-shi, Okayama-ken, 710-0048 (JP); Masahiro Kikuchi, Osaka (JP)

(73) Assignee: Kaoru Akahani, Okayama-ken (JP)

( * ) Notice: Subject to any disclaimer, the term of this patent is extended or adjusted under 35 U.S.C. 154(b) by 0 days.

(21) Appl. No.: 09/705,712

(22) Filed: Nov. 6, 2000

(30) Foreign Application Priority Data

Nov. 5, 1999 (JP) ..... 11-314869

(51) Int. Cl.[7] ..... B63B 59/04
(52) U.S. Cl. ..... 114/222; 405/216
(58) Field of Search ..... 114/222; 405/216; 422/6; 166/15.05

(56) References Cited

U.S. PATENT DOCUMENTS 3,570,256 A * 3/1971 Thompson
3,761,334 A * 9/1973 Zondek ..... 114/222
4,026,233 A * 5/1977 Cox
4,098,955 A * 7/1978 Partridge
5,279,244 A * 1/1994 Perez-Collazo
6,197,137 B1 * 3/2001 Akahani et al.

FOREIGN PATENT DOCUMENTS

JP 63-217012 * 9/1988

* cited by examiner

*Primary Examiner*—Sherman Basinger
(74) *Attorney, Agent, or Firm*—Browdy and Neimark

(57) ABSTRACT

This invention provides a method for keeping a structure such as a vessel, at least part of which is submerged, from being adhered to by aquatic organisms. In the method, the submerged part of the structure is covered up with a specific non-woven fabric. The non-woven fabric preferably has such a METSUKE value that each of the gaps between the fibers has an area of 1–60 $mm^2$, wherein the "METSUKE" means the weight of the fibers for one square meter of the non-woven fabric. The fabric typically has less than 1 mm thick.

20 Claims, No Drawings

METHOD FOR KEEPING A SUBMERGED STRUCTURE FROM BEING ADHERED TO BY AQUATIC ORGANISMS

TECHNICAL FIELD

This invention relates to a method for keeping a structure such as a vessel, at least part of which is submerged in water, from being adhered to by aquatic organisms, and more particularly, a method for keeping such an at-least-partly-submerged structure from being adhered to by aquatic organisms through a simple operation, without landing said structure, and at a low cost.

PRIOR ART

In the sea, there float larvae, spawn and seed of aquatic organisms such as barnacles, shellfish, sea weed and algae. These larvae, spawn and seed adhere to the submerged part of such vessels as fishing boats, fleets or leisure boats, which are at its moorings, and remaining adhered to the submerged part, colonize. If the vessel remains at its moorings for a long time, the organisms grow into a large mass. If such growth is left to adhere to the vessel, the vessel may be damaged by these organisms, which might lead to a considerable reduction of the vessel's lifetime. If the vessel sails with the organisms adhering to the submerged part, it causes reduction of fuel efficiency due to increased drag, as well as the rolling of the vessel, which may reduce the safety of navigation.

In order to mechanically scrape off these organisms, which are adhered to the submerged part of a vessel, the vessel must be landed, since the scraping operation cannot practically be done in the water. Landing a vessel, in turn, requires a lifting apparatus such as a crane, and a place for the operation, which is a large-scale operation, and therefore expensive. And it should also be noted that the scraping is a labor-intensive work.

Thus, to keep a vessel from being adhered to by aquatic organisms is essential and methods therefor have been devised.

One of the methods is to apply onto the vessel a paint for preventing aquatic organisms from adhering to the vessel. The paint application, however, also requires landing the vessel. Besides, the paint works only for a short time. Also, since some such paints include compounds poisonous to humans and marine animals, applying such a paint onto the vessel is not practicable for ecological reasons.

Methods that do not require landing the vessel have also been devised. Japanese patent laid-open (unexamined) publication No. 7(1995)-96891 described circumferencing the submerged part of a vessel with a waterproof sheet, the ends of which are drawn around and held in place by floats so as to prevent the seawater outside from entering into the new enclosure. Thus, the composition of the seawater enclosed by the waterproof sheet gradually changes, which results in the extermination of shellfish's spawn. Japanese patent laid-open publication No. 60(1985)-94892 teaches covering of the outside of a vessel with an opaque sheet. This method restrains aquatic organisms from maturing. Further, Japanese patent laid-open publication No. 4(1992)-50598 discloses extending inner-tubes along the bottom of a vessel and then pumping them up. Thus, the submerged part of the ship is closely covered with the inflated inner-tubes, which prevents aquatic organisms from adhering to the vessel. All of the methods, however, require a specially shaped material that is made by sewing or heat fusion. Also, the installing procedures of the material are complicated and, therefore, the labor costs are large. Consequently, these methods are not satisfactory.

Moreover, Japanese patent laid-open publication No. 63(1988)-22908 discloses a method of preventing aquatic organisms from adhering to the submerged part of a vessel. This method is characterized by "covering the surface of the sub-water part of a structure with a cloth, net or porous sheet that has a thickness of 1 mm or more and has pores through which water-exchange can easily be made." (See Claims of the publication.)

This publication states, "If the thickness of the sheet is less than 1 mm, it is difficult to prevent aquatic organisms from adhering to the ship." (See page 3, the lower right column, line 3 from the bottom to page 4, the upper left column, line 2 of the publication.) The Comparative Examples of this publication, in fact, show that a cloth having a thickness of 0.5 mm allowed many aquatic organisms to adhere to the submerged part of a vessel.

This publication further states, "Materials for the porous sheet . . . include urethane foam, foamed polystyrene or foamed polyethylene, with a parameter cell size 5–20/25 mm." (See page 3, lower right column, lines 12–17.) In Example 1 of the publication, a sheet of polyurethane having a thickness of 10 mm was used, in Example 7 a net of polypropylene, and in Example 8 a porous net-like structure made from a synthesized fiber.

As evidenced in the disclosure of the publication, the thickness of the porous sheet is sufficient enough to be termed "plate" rather than "sheet". In practice, such a thick sheet cannot cover a large sub-water part of a structure.

The purpose of the invention is to provide a method for keeping a structure such as a vessel, at least part of which is submerged, from being adhered to by aquatic organisms by a simple operation, without landing said structure, and at a low cost.

SUMMARY OF THE INVENTION

The present invention was made in order to realize the purpose and provides a method for keeping a structure, at least part of which is submerged, from being adhered to by aquatic organisms, which comprises covering all of the submerged part of the structure with a non-woven fabric sheet.

PREFERRED EMBODIMENTS OF THE INVENTION

This invention provides a method for keeping a structure, at least part of which is submerged, from being adhered to by aquatic organisms which comprises covering all of the submerged part of the structure with a sheet having the following features. We will illustrate the invention by taking the case of a vessel as an example.

The sheet used in this invention is a non-woven fabric. A non-woven fabric having a larger value of METSUKE, which is the weight of the fibers for one square meter of the non-woven fabric, is preferred. It is because a non-woven fabric having a larger value of METSUKE has a larger density of fibers from which the non-woven fabric is made, and therefore has smaller gaps between the fibers. This results in an effective obstruction to passage of larvae of barnacles, purplish Washington clams, sea squirts, etc. In this invention, a non-woven fabric having such a METSUKE value that each of the gaps has an area of 1–60 $mm^2$ is preferable.

When the area is so described, larvae of aquatic organisms adhere solely to the non-woven fabric to mature and they do not pass through the fabric or adhere to the vessel. Also, since the non-woven fabric has the gaps of which sizes are sufficient for water to freely pass through, water resistance against the fabric is small while the fabric is being moved in the sea for covering the vessel, which leads to a good operability. Consequently, when the area is within the described range, both of the obstruction to passage of aquatic organisms and the operability can simultaneously be improved.

If the METSUKE value of the non-woven fabric is less than the lower limit, since the sizes of the gaps between the fibers are larger, larvae of aquatic organisms do not adhere to the fabric but pass through the gaps to adhere to the vessel, although the operability becomes better. This means the intended prevention cannot be achieved. On the other hand, if the METSUKE value exceeds the upper limit, since the sizes of the gaps between the fibers are smaller, the fabric has less water permeability, although the passage of aquatic organisms is obstructed well. In other words, this impermeability increases water resistance against the non-woven fabric while the vessel is being covered with the fabric, which, in turn, decreases operability.

The non-woven fabric has usually a thickness of less than 1 mm, preferably that of 0.05–1 mm (only 0.05 being inclusive). If the thickness is 1 mm or larger, the fabric is not easy to handle when it is extended around the submerged part of the vessel. If the thickness is less than the lower limit, the fabric cannot have the strength sufficient to the requirements of the invention. The thickness of the non-woven fabric is more preferably 0.2–0.5 mm.

No restrictions are imposed on the size of the non-woven fabric, provided that the submerged part is completely covered with it. The size can be decided according to the size of the vessel, the method of covering the vessel, etc.

The non-woven fabric has such strength that the fabric cannot be torn when aquatic organisms amass on the fabric to a certain weight. When the fabric itself does not have a sufficient mechanical strength, a reinforcing member may be used to support the fabric. For example, the fabric can be reinforced with ribs or wires that are arranged on the fabric at appropriate distances.

Any chemical or natural fibers can be used for the materials of the non-woven fabric, as long as non-woven fabrics that satisfy the above-mentioned requirements can be produced from them. The chemical fibers include, for example, polyamide fibers, polyester fibers, polyacrylonitrile fibers, polyethylene fibers, polypropylene fibers, polyvinyl alcohol fibers, polyvinyl chloride fibers, polyvinylidene chloride fibers, polyurethane fibers, viscose fibers, acetate fibers, rayon fibers, etc. The natural fibers include, for example, cotton, hemp, wool, etc.

No restrictions are imposed on the methods of producing the non-woven fabric, as long as those that satisfy the above-mentioned requirements can be produced through them. For example, chemical bonding methods, fiber bonding methods, needle punching methods, stream entangling methods, spun bonding methods, melt blowing methods, flash spinning methods, etc. may be employed for producing the non-woven fabric in accordance with the present invention.

This invention provides a method for keeping a structure such as a vessel, at least part of which is submerged, from being adhered to by aquatic organisms by means of covering the submerged part with a non-woven fabric satisfying the requirements. No restrictions are imposed on the covering steps, provided that the submerged part is completely covered with the fabric when the covering operation is finished.

A vessel can be covered with one piece of non-woven fabric or two or more pieces thereof.

With the entire submerged part of a vessel covered with one piece of the non-woven fabric, an example of the methods for the covering is explained as follows: an end of the non-woven fabric is submerged from one side or the bow of a vessel, slid around the bottom and drawn up to the other side or the stern so as to cover the submerged part. By drawing up the end of the non-woven fabric above the water surface, the entire submerged part is covered.

When the entire submerged part of a vessel cannot be covered by one piece of the non-woven fabric, it is to be covered by several strips of the non-woven fabric. An example of this method is as follows: several strips of the non-woven fabric each having a certain width are prepared. One end of one of the strips is drawn from one side of a vessel under and up to the other side. Another strip is extended under the submerged part of the vessel in the same way, and the two strips are so arranged that their respective sides contact or overlap each other. Then, the sides are joined by such bonding means as an adhesive tape, glue, or twine, leaving no space between them. This operation is repeated to make a larger piece of the non-woven fabric from the strips until the entire submerged part of the vessel is covered. Alternatively, by similarly bonding the strips, a large piece of the non-woven fabric may be made on shore, and then submerged and extended under the entire submerged part.

Since the non-woven fabric of the invention is highly water-permeable, the resistance against the non-woven fabric during the covering operation is fairly low compared with that of a low water-permeable non-woven fabric, which results in a substantial reduction in labor. This low resistance is also beneficial when the non-woven fabric is removed.

After the covering operation, the hem of the non-woven fabric is secured, with ropes, belts or other such bindings, onto the non-submerged part of the ship or other structures above the water. When the hem is thus secured, care should be taken that the whole hem is kept above the water.

While the submerged part of a vessel is within the non-woven fabric, it is not necessary to keep the non-woven fabric sticking fast to the vessel. A consequent gap can be maintained between the vessel and the non-woven fabric, which makes the covering operation and moorage easier. The gap is preferably between about 1–10 cm, accounting for drift by the non-woven fabric from wave force.

If a vessel covered with the non-woven fabric is moored for a long time, aquatic organisms adhering to the non-woven fabric grow to a large mass, which, due to the weight of this mass, leads to hanging of the non-woven fabric. Thus, it could be difficult to continue to secure and support the non-woven fabric only by its hem, due to the fabric's limited strength. In order to provide the non-woven fabric with an auxiliary support, heavy-duty ropes or belts may be extended under the non-woven fabric at appropriate distances. Also, increasing the buoyant force of the non-woven fabric, tubes made of synthesized resins or rubbers may be fixed to the non-woven fabric at appropriate distances and air is sent through the tubes. Alternatively, before covering the vessel, the nonwoven fabric may be rimmed with pieces cut from a pressure-sensitive double-sided adhesive tape, with one adhesive side being stuck on the non-woven fabric at appropriate distances. The other sides are applied to the surface of the vessel while the vessel is being covered.

When the vessel is ready to depart, the non-woven fabric can easily be removed from the vessel. Further, the removed non-woven fabric can be re-used as it is, if the adhering aquatic organism mass is small.

The method in accordance with the invention can be applied to structures other than vessels, at least the respective parts of which are submerged. Such structures include floating piers, underwater culture equipment and floating culture equipment, equipment for excavating sub-marine oil fields, floating lamps for guiding vessels, floating lighthouses, buoys, floating heliports, ropes placed on the sea or in the sea for various purposes, etc. These structures can also be kept from being adhered to by aquatic organisms, similarly by covering the entire surface of the submerged part with the non-woven fabric, which is then secured.

Through the method of the invention, only by covering structures such as vessels, at least parts of which are submerged, with a non-woven fabric having specified characters, can the submerged parts of the structures be effectively kept from being adhered to by aquatic organisms.

Since this invention can be carried out without landing a structure such as a vessel, at least part of which is submerged, a place for the landing and a lifting apparatus such as a crane are not required. Therefore the method in accordance with the invention can be done wherever the vessel is moored. Also, since the operation required by the method is only to cover a structure such as a vessel with the non-woven fabric, the number of the workers can be small, which results in small personnel expense.

Since the non-woven fabric of the invention has a sufficiently good water-permeability, water resistance against the non-woven fabric is lowered while the structure is being covered with or stripped of the non-woven fabric. Consequently, the method of the invention can achieve a substantial reduction in labor compared with a method using a low water-permeable non-woven fabric. Also, since the invention does not require keeping the non-woven fabric sticking fast to the vessel, it makes the operation easier.

We claim:

1. A method for keeping aquatic organisms from adhering to a structure, at least part of which is submerged, which comprises covering an entire submerged part of the structure with a non-woven fabric consisting of fibers which are united with gaps therebetween wherein each of the gaps has an area of 1–60 $mm^2$.

2. The method as claimed in claim 1, wherein the structure is a vessel.

3. The method as claimed in claim 1, wherein the non-woven fabric has a thickness of less than 1 mm.

4. The method as claimed in claim 1, wherein the non-woven fabric is reinforced with ribs or wires that are arranged on the fabric at appropriate distances.

5. A method for keeping aquatic organisms from adhering to a structure, at least part of which is submerged in water, which comprises:

preparing a non-woven fabric made from fibers which are united with gaps therebetween wherein each of the gaps has an area of 1–60 $mm^2$, the non-woven fabric having a thickness of less than 1 mm;

submerging an end of the non-woven fabric from one side of the structure;

sliding the end around the submerged part; and drawing up the end to the outer side and above the water to cover the entire submerged part.

6. The method as claimed in claim 5, further comprising securing a hem of the non-woven fabric with bindings onto a non-submerged part of the structure or other structures above the water after the end is drawn up above the water.

7. The method as claimed in claim 5, wherein one piece of the non-woven fabric is used for covering the entire submerged part.

8. The method as claimed in claim 5, wherein two or more pieces of the non-woven fabric are used for covering the entire submerged part.

9. The method as claimed in claim 5, further comprising providing said non-woven fabric with an auxiliary support.

10. The method as claimed in claim 9, wherein the auxiliary support comprises extending heavy-duty ropes or belts under the non-woven fabric at appropriate distances.

11. The method as claimed in claim 9, wherein the auxiliary support comprises fixing tubes made of synthesized resins or rubbers to the non-woven fabric at appropriate distances and sending air through the tubes to increase the buoyant force of the non-woven fabric.

12. The method as claimed in claim 9, wherein the auxiliary support comprises rimming the non-woven fabric with pieces cut from a pressure-sensitive double-sided adhesive tape, with one adhesive side being stuck on the non-woven fabric at appropriate distances, before submerging the non-woven fabric; and applying the other sides to a surface of the structure while the submerged part is being covered.

13. The method as claimed in claim 5, wherein the structure is one selected from the group consisting of a vessel, a floating pier, an underwater culture equipment and floating culture equipment, an equipment for excavating sub-marine oil fields, a floating lamp for guiding vessels, a floating lighthouse, a buoy, a floating heliport, and a rope placed on the sea or in the sea.

14. The method as claimed in claim 5, wherein the non-woven fabric is reinforced with ribs or wires that are arranged on said fabric at appropriate distances.

15. A method for keeping aquatic organisms from adhering to a structure, at least part of which is submerged in water, which comprises:

preparing a non-woven fabric consisting of fibers which are united with gaps therebetween wherein each of the gaps has a area of 1–60 $mm^2$, the non-woven fabric having a thickness of less than 1 mm;

submerging an end of the non-woven fabric from one side of the structure;

sliding the end around the submerged part; and drawing up the end to the other side of the structure and above the water so as to cover the entire submerged part of the structure.

16. The method according to claim 15, further comprising securing a hem of the non-woven fabric with bindings onto a non-submerged part of the structure or other structures above the water after the end is drawn up above the water.

17. The method according to claim 15 wherein two or more pieces of the non-woven fabric are used for covering the entire submerged structure.

18. The method according to claim 15 wherein the structure is selected from the group consisting of vessels, floating piers, underwater culture equipment, floating culture equipment, equipment for excavating sub-marine oil field, floating lamps for guiding vessels, floating lighthouses, buoys, floating heliports, and ropes placed on the sea or in the sea.

19. The method according to claim 15 wherein the non-woven fabric is reinforced with ribs or wires that are arranged on said fabric at appropriate distances.

20. The method according to claim 16 further comprising providing said non-woven fabric with an auxiliary support.

* * * * *